United States Patent [19]

Arbique

[11] 4,373,520

[45] Feb. 15, 1983

[54] RESPIRATOR SPEECH UNIT/OUTLET VALVE

[75] Inventor: Roland H. Arbique, Hull, Canada

[73] Assignee: Her Majesty the Queen in Right of Canada, as represented by the Minister of National Defence, Canada

[21] Appl. No.: 178,186

[22] Filed: Aug. 14, 1980

[30] Foreign Application Priority Data

Sep. 28, 1979 [CA] Canada ..... 336600

[51] Int. Cl.[3] ..... A62B 7/00

[52] U.S. Cl. ..... 128/201.19; 128/206.15

[58] Field of Search ..... 128/201.19, 206.15; 181/21, 128, 148, 18, 126, 157

[56] References Cited

U.S. PATENT DOCUMENTS 3,109,425 11/1953 Gongoll et al. ..... 128/201.19

FOREIGN PATENT DOCUMENTS 566088 12/1944 United Kingdom ..... 128/201.19

572888 10/1945 United Kingdom ..... 128/201.19

*Primary Examiner*—Henry J. Recla

*Attorney, Agent, or Firm*—Stevens, Davis, Miller & Mosher

[57] ABSTRACT

An improved respirator speech unit for the light-type or other model of respirator. The unit has a speech transmitter disc positioned within a frame. To the speech transmitter disc is secured a rigid valve seat disc. This valve seat disc is secured parallel to and coaxial with the transmitter disc so that, in position, it will be externally positioned in the frame. The valve seat disc is transversely seatable in the frame with its periphery cooperating with seal means in the frame to prevent passage of air between its periphery and the frame. The valve seat disc has a circular aperture for passage of exhaled air from the mask and defines, with the speech transmitter disc in position in the frame, an air passage from within the mask to this aperture. A flexible circular outlet valve is secured at its center to the other end of the frame, the valve being aligned with the aperture and resting thereon so that, when in position, this valve permits passage of air from the mask through the aperture, but seals the aperture to prevent entry of outside air into the mask. A respirator speech unit according to this construction is more reliable and more serviceable than the previously known constructions of respirator speech units which had a peripheral aperture for passage of air between the edge of the speech transmitter disc and the frame and an annular flexible seal operating to close that passage.

8 Claims, 5 Drawing Figures

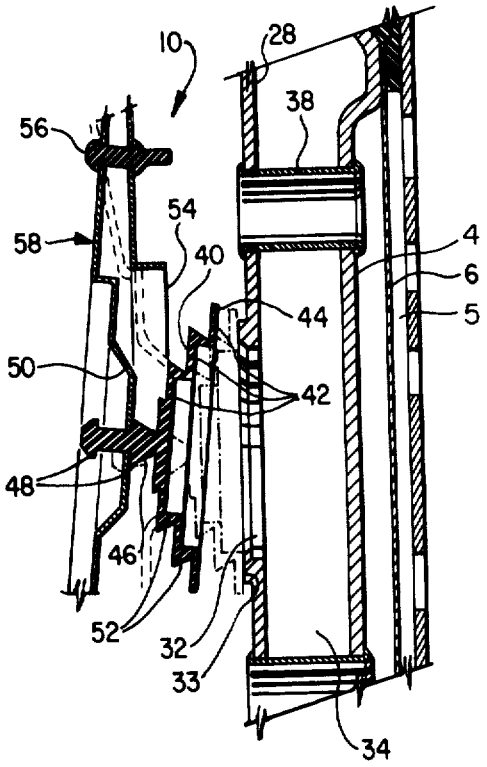
FIG. 4
FIG. 5
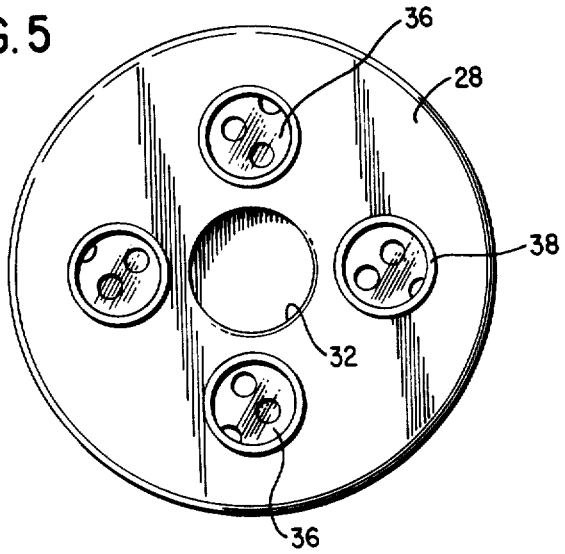

RESPIRATOR SPEECH UNIT/OUTLET VALVE

BACKGROUND OF THE INVENTION

This invention relates to an improved respirator speech unit for a light-type respirator.

Light-type respirators are used by military and civilian organizations to shield a wearer's face and control the air supply, thus providing protection against toxic or noxious gases or other substance in the air. The type most commonly used has a rubber shell which fits over the wearer's face with the wearer drawing in purified air through a canister filter and exhaling to the atmosphere through an outlet control mechanism. As well, such a mask has a respirator speech unit containing a speech transmitter disc with a diaphragm, often of Mylar (trade mark) film so that the wearer's voice can be passed to the outside and the wearer can consequently communicate with others.

The outlet control mechanism of such a mask is usually associated with the respirator speech unit. A peripheral air passage is provided between the frame of the speech unit and the periphery of the speech transmitter disc, which passage is blocked when the wearer is not exhaling by a flexible annular valve positioned externally to the speech transmitter disc within the speech unit. The valve seals off the passage against flow of air from outside the mask but opens to permit flow of air from within the mask to the outside when the wearer exhales. The outward motion of expelled air when the wearer is exhaling prevents return flow reversion while this valve is open.

There have been several problems associated with the use of such gas masks. The speech transmitter disc in these units is centrally positioned in a cylindrical frame by screwing a support in which it is held into a corresponding receptacle in the closed end of the frame. To screw this support into the frame, the valve must be in position between the frame and this support. Consequently, unless care is taken when inserting the speech transmitter disc, the twisting action on the support may be transmitted to the valve and cause distortion or tearing of the valve and/or uneven compression because of tightening tolerances. In practice, therefore, maintenance of gas masks and fitting of the parts of the respirator speech unit together is done not by troops or men in the field, but by qualified and skilled expert technicians. Moreover, it is difficult and time consuming to clean or free the valve from foreign material as disassembly is necessary. This cannot be accomplished in the field and protection is lost until the mask is serviced or replaced. When a valve is in place in a respirator speech unit, it is not convenient to do day-to-day checks to ensure that the valve is operating properly or has not deteriorated to the point that it should be replaced. The mask must instead periodically or as required be returned to expert technicians to be overhauled.

Yet another problem with such respirator speech units is that because the valve is a relatively large flexible ring exposed to the atmosphere, dust readily accumulates on the valve and frequently prevents it from completely or effectively providing a seal when the wearer is not exhaling. This problem can produce serious consequencies for a wearer if it arises in the field; on a day-to-day basis, this problem requires regular maintenance by expert technicians even when the mask is not in use.

The outlet valve/speech unit now used has no provision for free breathing while the gas mask is being worn while harmful gas is absent, so the wearer becomes fatigued unnecessarily from the resistance caused by the canister and outlet valve to respiration. Additionally, in such a case, the canister becomes contaminated with dust and other impurities while its protection is not required.

Speech transmission qualities of such known respirator speech units are not high, speech vibrations being channelled through a reducing-diameter cone to the atmosphere so that there is a consequent reduction in sound propagation and some distortion as a result.

It is an object of the present invention to provide an improved respirator speech unit which will overcome or assist in reducing the above mentioned problems and difficulties of the known unit. It is a further object of the present invention to provide a construction of respirator unit which may additionally be provided with a means to allow free in/out air flow when there is no contamination nearby, while the mask is worn, which air flow could be immediately cancelled to provide filtration and prevent entry of outside air into the mask.

SUMMARY OF INVENTION

In accordance with the present invention, an improved respirator speech unit for a light-type gas mask is provided of the type having a rigid cylindrical frame, closed at one end and secured at the other end to the front of the gas mask, a screen means secured to the frame for air passage, a speech transmitter disc positioned within the frame and defining within the frame a passage for air from one side of the disc within the frame to the other and a flexible outlet valve sealing off the passage against flow of air from outside the mask to inside and opening to permit expelling of air from the mask when the wearer exhales. Particularly, the improvement comprises the speech transmitter disc having secured to and spaced coaxially and parallel from it an externally positioned rigid valve seat disc, the valve seat disc being transversely seatable in the frame. The periphery of the valve seat disc co-operates with seal means in the frame to prevent flow of air between its periphery and the frame. The valve seat disc has a circular aperture for passage of exhaled air from the mask. The speech transmitter disc and the valve seat disc, when in position within the frame, define a passage for air within the mask to this aperture. A flexible, preferably of disc-like shape, circular outlet valve is secured at its centre to the outer end of the frame. The valve, when in operative position, is concentric with and covers the aperture to co-operate therewith, at least a portion of the periphery of the valve overlapping the edges of the aperture. When in operation, the valve flexes to permit passage from the mask through the aperture of exhaled air and seals the aperture to prevent entry through it into the mask of outside air. In one embodiment of the invention, the closed end of the frame is further provided with a centrally located hole across which is moveably positioned a hinged valve holder means to which the valve is secured. The valve holder means, when in the open position, permits entry of air from the atmosphere through the hole and aperture directly into the mask, and, when closed, when the wearer is not exhaling holds the valve in position against the aperture to prevent entry of air into the gas mask.

The respirator speech unit according to the present invention provides an outlet valve which offers minimum resistance to opening but which is constructed so that it is stiff enough to provide valve seat pressure for effective sealing. This valve is smaller, lighter and simpler than the valve of the known respirator speech unit previously described, and is therefore more economical than that current design. By permitting higher valve seat pressure than the heavy, large diameter valve required in the old device, it permits firmer sealing while, at the same time, more even and regular opening around its circumference exposing more of the outlet area for exhaling, thereby resulting in reduced breathing resistance.

The device according to the present invention, by avoiding screw-threaded parts, also avoids a persistent trouble source of the assembly now used.

Insofar as the embodiment of the present invention having a hinged valve holder means to which the valve is secured is concerned, this embodiment gives access of a wearer in the field to the valve and aperture to permit release of a stuck valve or removal of foreign material which may impede the operation of the device. Additionally, such an embodiment permits the outlet valve to be easily replaced.

The arrangement of the diaphragm holder and valve seat plate according to the present invention provides a large diaphragm for speech transmission near the wearer's mouth but still allows the use of the small outlet valve.

BRIEF DESCRIPTION OF THE DRAWINGS

Other objects and advantages of the present invention will become apparent upon reading the following description and upon referring to the drawings in which:

FIG. 4 is a schematic section view of the valve and valve seat in close and open portion in the respirator speech unit of FIGS. 2 and 3 illustrating the air flow patterns;

FIG. 5 is a plan view of the valve seal disc of the unit according to the present invention.

Figure 1:
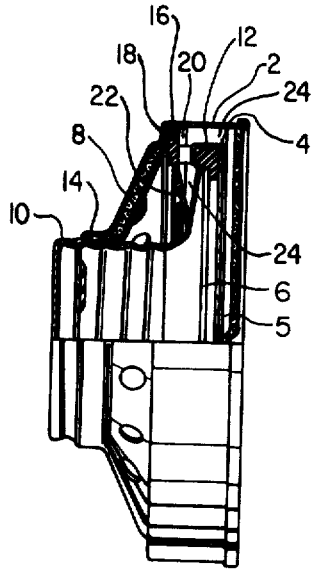
FIG. 1 Prior Art.
FIG. 1 is a section view of a respirator speech unit of a type now commonly used on light-type respirator gas masks.

While the invention will be described in connection with example embodiments thereof, it will be understood that it is not intended to limit the invention to those embodiments. On the contrary, it is intended to cover all alternatives, modifications and equivalents as may be inclined within the spirit and scope of the invention as defined by the appended claims.

DETAILED DESCRIPTION OF THE INVENTION

In the figures, similar features have been given similar reference numerals.

Turning first to FIG. 1, there is shown in section a view of a conventional respirator speech unit used on light-type respirators to date. As shown in this figure, the unit is provided with a frame 2 in which speech transmitter 4 is transversely positioned. Between the exterior, closed end of frame 2 and the portion of the frame at which the speech transmitter 4 is held, the transmitter 4 takes the form of a reducing-diameter cone, this being opposite to the desired speaker-shape which would optimize sound propagation. A Mylar (trade mark) diaphragm 6 is positioned within speech transmitter 4. A perforated spacer disc 5 is provided to protect diaphragm 6. Screen 8 is provided in the base portion 10 of the frame to protect the air passage and diaphragm from foreign articles.

Diaphragm 6 is held in holder 12 which holder is secured in base portion 10 by means of screw thread arrangement 14 at the end of transmitter 4. To prohibit air from the atmosphere entering the inside air space of a gas mask when the wearer is not exhaling, and to permit exhaled air to be expelled from the gas mask when the wearer is exhaling, annular valve 16 is secured on ledge 18 of frame 2 by ring washer 20 and the corresponding portion of transmitter 4. In this position, the internal end 22 of valve 16 bears against the external side of transmitter 4 about its circumference to seal off the annular aperture formed between the periphery of speech transmitter 4 and the corresponding portion of holder 12, and the corresponding portions of frame 2. Air from within the gas mask, when being worn, is expelled as the wearer exhales, valve end 22 curling open to permit exhaled air to pass from air passage 24 to the external part of frame 2 and to the atmosphere. As the wearer begins to breath out, a dead air space between base portion 10 and the valve 16 provides a barrier (buffer zone) to entry of outside air until flow is established.

Valve 16 is a relatively heavy, large diameter valve, and consequently is relatively inefficient. Valve seat pressure is relatively low because of the large contact area between valve end 22 and the corresponding portion of speech transmitter 4. The valve curls open on only a small section of its circumference during exhaling, which fact increases respiration resistance due to reduced outlet area. There is no provision for the wearer to open valve 16 when the gas mask is being worn while harmful gases are absent, so the wearer may become fatigued unnecessarily from the resistance of the canister and outlet valve to respiration and so that the canister may become contaminated with dust and other impurities while its protection is not needed. It will also be understood that it is difficult and time consuming to clean or free valve 16 from foreign material, disassembly of the whole unit being required. This cannot be accomplished in the field and consequently protection is lost until the mask is replaced or repaired. Moveover, it has been the experience with this arrangement that the valve 16 experiences leakage when worn for extended periods in dusty conditions. Also, because of the screw thread connection between the base 10 and the speech transmitter, twisting of the transmitter 4 when inserting it into the base 10 is another source of distortion on valve 16.

Figure 3:
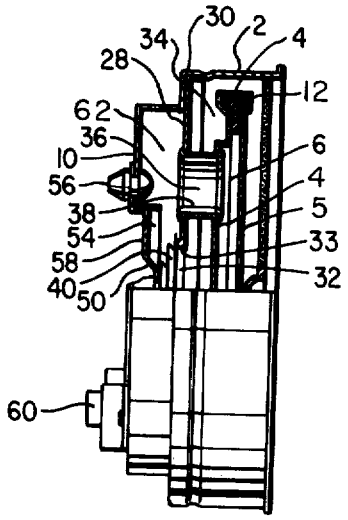
FIG. 3 is a side view in partial section of the respirator speech unit of FIG. 2.
Figure 2:
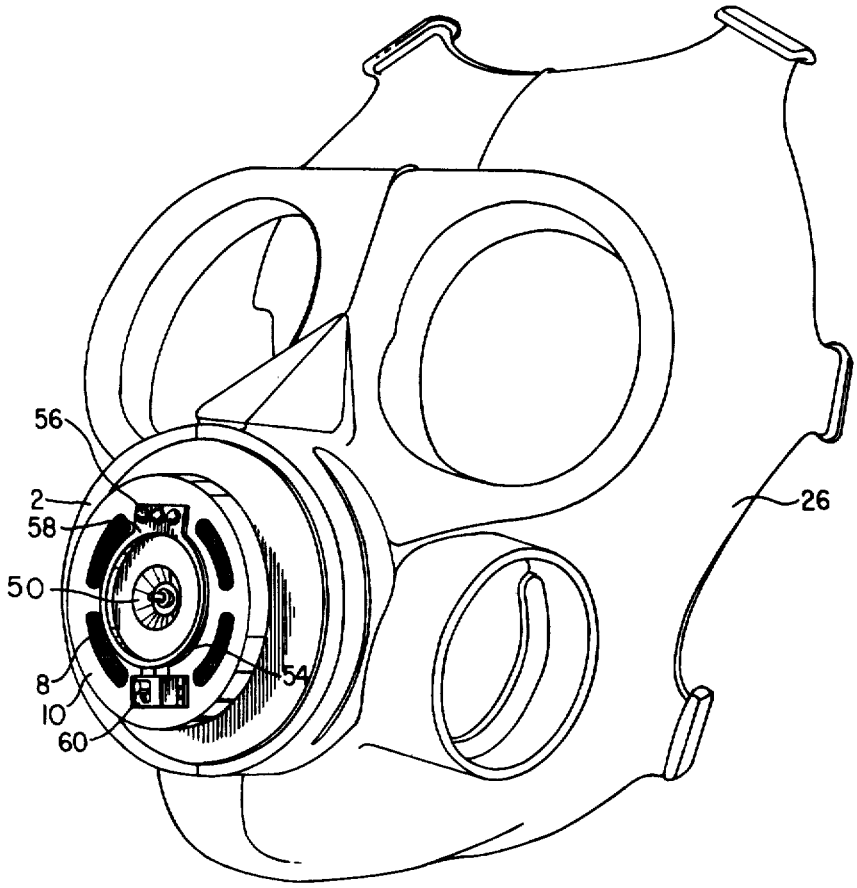
FIG. 2 is perspective view of a light-type respirator gas mask on which is mounted an improved respirator speech unit according to the present invention.

Turning now to FIG. 2, the improved respirator speech unit of the present invention, as illustrated on a light type respirator 26 again has a frame 2 having screens 8. As seen in FIG. 3, the speech transmitter is a disc 4 which is transversely positioned within the frame. Transmitter disc 4 is bent over at its edge to form a holder 12 for a circular Mylar diaphragm 6 and perforated spacer disc 5 which protects the diaphragm. However, to the speech transmitter disc is secured a rigid valve seat disc 28, this disc being secured parallel to and coaxial with the speech transmitter disc and spaced from it (FIG. 3) so that it is externally positioned in the frame with respect to the transmitter disc. Disc 28 is seatable in the frame, with its periphery co-operating with seal means 30 and frame 2 to prevent passage of air between its periphery and the frame. It will be noted from FIG. 3 that the speech transmitter is in the form of a disc 4 and does not have a conical form, thus assisting in the transmission of sound passed through the transmitter disc to the atmosphere, as compared to the prior art device. The valve seat disc 28 has centrally disposed circular aperture 32 which, as will be explained subsequently, permits passage of exhaled air from the mask. This disc 28 defines, with speech transmitter disc 4 in position in the frame as shown in FIG. 3, an air passage 34 from within the mask to aperture 32. The central position of aperture 32 permits an indirect route from the aperture to air outside the frame of the unit, providing increased protection against reversion. As shown in FIGS. 3 and 5, speech transmitting apertures 36 formed by cylindrical tubes 38 communicate directly from the external surface of the speech transmitter disc 4 to external air beyond circular aperture 32 and tubes 38 provide openings for the sound of the wearer's voice to pass through.

A flexible circular outlet valve 40 is secured at its centre to the closed end of base portion 10 of the frame, valve 40 being aligned with aperture 32 and seated on the external edges thereof so that, when in position as illustrated in FIG. 3, aperture 32 is sealed to prevent entry of outside air into the mask. A stop such as a screen (not shown) may advantageously be secured across aperture 32 to ensure that valve 40 does not accidentally become drawn through or stuck in the aperture and thereby disrupt the operation of the unit. Peripheral edge 33 of aperture 32 may be slightly raised towards valve 40 as shown to assist the seal therewith, although this feature does not appear to be necessary. As can be seen in FIG. 4, outlet valve 40 which is preferably made of rubber or other flexible material, is provided with a plurality of concentric annular sections 42, extending, in stepped fashion, with diminishing diameter, from flange 44 to stem 46, valve 40 being secured in the end wall of frame 2 by means of stops 48 positioned on the stem. It will be noted from FIG. 2 that the end wall of frame 2, in the area to which outlet valve 40 is secured projects inwardly to form nub 50. This nub permits free, unobstructed distortion of valve 40 when exhaled air passes through aperture 32. Annular sections 42 are joined to adjacent sections by means of inwardly bevelled edges 52.

In the embodiment illustrated in FIGS. 2 to 5, the external, closed base portion 10 of frame 2 is further provided with a hole 54 across which is mounted, by means of hinges 56, a valve holder 58. Latch 60, as shown in FIG. 4 (phantom lines), maintains the valve holder closed across hole 54 with valve 40 in seated position across circular aperture 32, and also enables valve holder 58 to be kept, as shown in FIG. 4 (solid lines), in open position with flexible outlet valve 40 spaced from aperture 32 to permit entry of outside air directly into passage 34 and the inside of the gas mask.

It will be understood that while the securing of flexible outlet valve 40 to a moveable valve holder 58 is considered to be a desirable feature of this invention, it is likely that a gas mask having the improved speech transmitter disc and outlet valve according to the present invention would be used on a mask without that feature, for example in conditions where there should be no risk that the wearer might inadvertently leave the valve holder open. In such instances, it is within the scope of the present invention to provide a construction where the closed end of the speech transmitter is not provided with such a moveable valve holder 58 and hole 54, but instead where this base portion 10 is, except for screens 8, entirely closed, and outlet valve 40 is held by a nub 50 on this closed base portion 10.

In operation, when a light type respirator having the respirator speech unit according to the present invention is worn, exhaled air has a direct passage through passage 34 to aperture 32. As seen in FIG. 4 the stepped outlet valve will tend to open evenly around its circumference, to permit passage of this exhaled air, instead of remaining partially closed like a cone-shaped valve, as is the case with the prior art device described herein. This exposes the entire outlet area and results in reduced breathing resistance. The acute-edged seat which seat may also be flat provides good valve contact pressure against the surface of valve seat disc 28 about aperture 32 when the wearer is not exhaling, to minimize the chance of outside air entering the mask. It will be understood that appropriate valve contact pressure can be achieved by adjusting the position on stem 46 at which the valve 40 is secured, as well as the height of nub 50. When the moveable valve holder feature of FIGS. 2 and 3 is utilized, provision is thereby made for free breathing while the gas mask is being worn when harmful gases are absent, so that the wearer will not become fatigued from the resistance of the canister and outlet valve to respiration, and so that the canister will not become contaminated with dust and other impurities during the time when its protection is not required. As well this feature significantly reduces the difficult and time consuming task of cleaning and freeing the valve 40 from foreign material, and will not require, as in previous devices, disassembly of the respirator speech unit for correction or maintenance. The valve according to the present invention also permits extremely simple and ready replacement when worn or damaged. No twisting or screwing of components into position is required.

As well, as can be seen from FIGS. 2 and 3, since the frame of the unit does not consist of a reducing diameter cone, the unit according to the present invention optimizes sound propagation. The arrangement of the holder 12 and disc 28 permits the diaphragm to be located near the wearer's mouth, and also allows use of a small outlet valve with the advantages of relatively good valve contact pressure and, during exhaling, exposure of the entire outlet area for reduced breathing resistance. Also, the use of the smaller outlet valve 40, as compared to the larger annular valve 16 commonly used at the present time, increases the effectiveness of the buffer zone 62 (located between the valve seat disc 28 and base portion 10 of frame 2) which buffer zone restricts the exposure of contaminated air to the valve 40. Consequently, the chance that contaminated air might leak through circular aperture 32 into the mask is reduced.

Thus it is apparent that there has been provided in accordance with the present invention an improved respirator speech unit for a light type respirator that fully satisfies the objects, aims and advantages set forth above. While the invention has been described in conjunction with specific example embodiments thereof, it is evident that many alternatives, modifications and variations will be apparent to those skilled in the art in light of the foregoing description. Accordingly it is intended to embrace all such alternatives, modifications and variations as fall within the spirit and broad scope of the appended claims.

The embodiments of the invention in which an exclusive property or privilege is claimed are defined as follows:

1. A speech transmitting unit for use with a respirator, said respirator including an air inlet and an air outlet, said unit comprising a cylindrical open-ended frame, one end of which is to be connected to said air outlet;

a rigid valve seat disc transversely disposed in said frame adjacent the other end of the frame, providing an air-tight seal between said frame and said valve seat disc;

first and second openings in said valve seat disc, said first opening being in the form of a circular aperture;

a one-way valve associated with said circular aperture to permit the exit of exhaled air from said respirator and to prevent the entry of outside air into said respirator when the wearer thereof is not exhaling;

a speech transmitter disc including a diaphragm, transversely disposed in said frame adjacent said one end of the frame and spaced from said valve seat disc, said transmitter disc being of a diameter somewhat smaller than the diameter of said frame, to define together with said valve seat disc and said frame, a peripheral exhaled air-flow path between said one end of the frame and said circular aperture; an opening in said speech transmitter disc; and conduit means for connecting said opening in said speech transmitter disc with said second opening in said valve seat disc to provide an outlet path for speech transmission, wherein said valve is in the form of a flexible disc secured at its center to an outer end of the frame, the valve in operative position being concentric with and covering the aperture to cooperate therewith, at least a portion of the periphery of the valve overlapping the edges of the aperture, the valve, when in operation, flexing to permit passage of exhaled air from the respirator through said aperture and then sealing the aperture to prevent entry through the aperture into the respirator of outside air.

2. A speech unit according to claim 1 wherein the frame includes a base portion in the form of an outward extension beyond said valve seat disc and wherein said base portion has a centrally located circular opening which is coaxial with said circular aperture and wherein a circular valve holder means to which said valve is attached is hinged to said base portion, the valve holders means, when in open position permitting entry of air from the atmosphere through the circular aperture into the respirator and, when closed, holding the valve in position against the circular aperture to prevent entry of air into the respirator when the wearer thereof is not exhaling.

3. A speech unit according to claim 1, wherein the valve is provided with an annular peripheral flange, at least a portion of the flange overlapping the edges of the aperture when in operative position to seal it against passage of outside air into the respirator.

4. A speech unit according to claim 3, wherein the valve has a plurality of concentric annular sections extending, in stepped fashion, with diminishing diameter from the flange up to the center of the valve.

5. A speech unit according to claim 4, wherein the annular sections of the valve are joined to adjacent sections by externally inwardly bevelled edges.

6. A speech unit according to claim 1, wherein the circular aperture and valve are positioned centrally within the frame when in operation.

7. A speech unit according to claim 1, wherein the frame is further provided with latch means to hold the hinged valve holder tightly closed when in closed position, and to hold it open when in open position.

8. A speech unit according to claim 1, wherein the peripheral edge on the external side of the aperture are slightly raised towards the valve to improve the seal therewith.

* * * * *